US009531061B2

(12) United States Patent
Han et al.

(10) Patent No.: US 9,531,061 B2
(45) Date of Patent: Dec. 27, 2016

(54) ELECTRONIC DEVICE ANTENNA WITH REDUCED LOSSY MODE

(71) Applicant: Apple Inc., Cupertino, CA (US)

(72) Inventors: Liang Han, Sunnyvale, CA (US); Matthew A. Mow, Los Altos, CA (US); Ming-Ju Tsai, Cupertino, CA (US); Yijun Zhou, Sunnyvale, CA (US); Hongfei Hu, Santa Clara, CA (US); Salih Yarga, Sunnyvale, CA (US); Mattia Pascolini, San Francisco, CA (US); Yuehui Ouyang, Sunnyvale, CA (US); Erdinc Irci, Sunnyvale, CA (US); Enrique Ayala Vazquez, Watsonville, CA (US); Robert W. Schlub, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 314 days.

(21) Appl. No.: 14/476,490

(22) Filed: Sep. 3, 2014

(65) Prior Publication Data

US 2016/0064801 A1 Mar. 3, 2016

(51) Int. Cl.

| | |
|---|---|
| ***H01Q 1/24*** | (2006.01) |
| ***H01Q 9/42*** | (2006.01) |
| ***H01Q 13/10*** | (2006.01) |
| ***H01Q 5/328*** | (2015.01) |

(52) U.S. Cl.

CPC ..... *H01Q 1/243* (2013.01); *H01Q 5/328* (2015.01); *H01Q 9/42* (2013.01); *H01Q 13/10* (2013.01)

(58) Field of Classification Search

CPC ..... H01Q 13/10; H01Q 5/328; H01Q 9/42; H01Q 1/243

USPC ..... 343/700 MS, 702, 745

See application file for complete search history.

(56) References Cited

U.S. PATENT DOCUMENTS

| | | | |
|---|---|---|---|
| 7,876,274 | B2 | 1/2011 | Hobson et al. |
| 8,270,914 | B2 | 9/2012 | Pascolini et al. |
| 8,610,629 | B2 | 12/2013 | Pascolini et al. |
| 2011/0188552 | A1 | 8/2011 | Yoon et al. |

(Continued)

OTHER PUBLICATIONS

Bevelacqua et al., U.S. Appl. No. 13/860,396, filed Apr. 10, 2013.

(Continued)

*Primary Examiner* — Khai M Nguyen

(74) *Attorney, Agent, or Firm* — Treyz Law Group, P.C.; G. Victor Treyz; Michael H. Lyons

(57) ABSTRACT

An electronic device may be provided with an antenna. The antenna may have an antenna resonating element and an antenna ground. An adjustable inductor may be coupled between the antenna resonating element and the antenna ground. An antenna feed may have a positive feed terminal coupled to the antenna resonating element and a ground antenna feed coupled to the antenna ground. The adjustable inductor may have first and second inductors coupled to respective first and second ports of a switch. The switch may have a third port coupled to the antenna ground. A capacitor may have a first terminal coupled to ground and a second terminal coupled to the first inductor at the first port of the switch. An inductor may be coupled between the antenna resonating element and antenna ground at a location between the adjustable inductor and the antenna feed.

20 Claims, 10 Drawing Sheets

(56) References Cited

U.S. PATENT DOCUMENTS

| | | | | |
|---|---|---|---|---|
| 2011/0241949 | A1 | 10/2011 | Nickel et al. | |
| 2012/0112969 | A1 | 5/2012 | Caballero et al. | |
| 2012/0112970 | A1 | 5/2012 | Caballero et al. | |
| 2012/0229347 | A1* | 9/2012 | Jin | H01Q 1/243 343/702 |
| 2012/0299785 | A1 | 11/2012 | Bevelacqua | |
| 2013/0169490 | A1* | 7/2013 | Pascolini | H01Q 5/357 343/702 |
| 2013/0194139 | A1 | 8/2013 | Nickel et al. | |
| 2013/0201067 | A1 | 8/2013 | Hu et al. | |
| 2013/0203364 | A1 | 8/2013 | Darnell et al. | |
| 2013/0257659 | A1 | 10/2013 | Darnell et al. | |
| 2014/0187178 | A1 | 7/2014 | Yang et al. | |
| 2014/0266922 | A1 | 9/2014 | Jin et al. | |
| 2014/0266941 | A1 | 9/2014 | Vazquez et al. | |

OTHER PUBLICATIONS

Vazquez et al., U.S. Appl. No. 13/889,987, filed May 8, 2013.
Hu et al., U.S. Appl. No. 13/890,013, filed May 8, 2013.
Bevelacqua et al., U.S. Appl. No. 13/851,471, filed Mar. 27, 2013.
Jin et al., U.S. Appl. No. 13/846,471, filed Mar. 18, 2013.
Ouyang et al., U.S. Appl. No. 13/846,459, filed Mar. 18, 2013.
Zhou et al., U.S. Appl. No. 13/846,481, filed Mar. 18, 2013.
Vazquez et al., U.S. Appl. No. 14/096,417, filed Dec. 4, 2013.

* cited by examiner

ELECTRONIC DEVICE ANTENNA WITH REDUCED LOSSY MODE

BACKGROUND

This relates generally to electronic devices and, more particularly, to electronic devices with antennas.

Electronic devices often include antennas. For example, cellular telephones, computers, and other devices often contain antennas for supporting wireless communications.

It can be challenging to form electronic device antenna structures with desired attributes. In some wireless devices, the presence of conductive housing structures can influence antenna performance. Antenna performance may not be satisfactory if the housing structures are not configured properly and interfere with antenna operation. Device size can also affect performance. It can be difficult to achieve desired performance levels in a compact device, particularly when the compact device has conductive housing structures.

It would therefore be desirable to be able to provide improved wireless circuitry for electronic devices such as electronic devices that include conductive housing structures.

SUMMARY

An electronic device may be provided with an antenna. The antenna may have an antenna resonating element and an antenna ground. An adjustable inductor may be coupled between the antenna resonating element and the antenna ground to tune the antenna. An antenna feed may have a positive feed terminal coupled to the antenna resonating element and a ground antenna feed coupled to the antenna ground. The adjustable inductor may have first and second inductors coupled to respective first and second ports of a switch. The switch may have a third port coupled to the antenna ground. A capacitor may have a first terminal coupled to ground and a second terminal coupled to the first inductor at the first port of the switch. An inductor may be coupled between the antenna resonating element and antenna ground in parallel with the adjustable inductor at a location between the adjustable inductor and the antenna feed.

The electronic device may have a housing. The housing may have a periphery that is surrounded by peripheral conductive housing structures. The antenna resonating element may be formed from at least some of the peripheral conductive housing structures. The antenna may be a hybrid inverted-F slot antenna or other suitable antenna.

DETAILED DESCRIPTION

Figure 1:
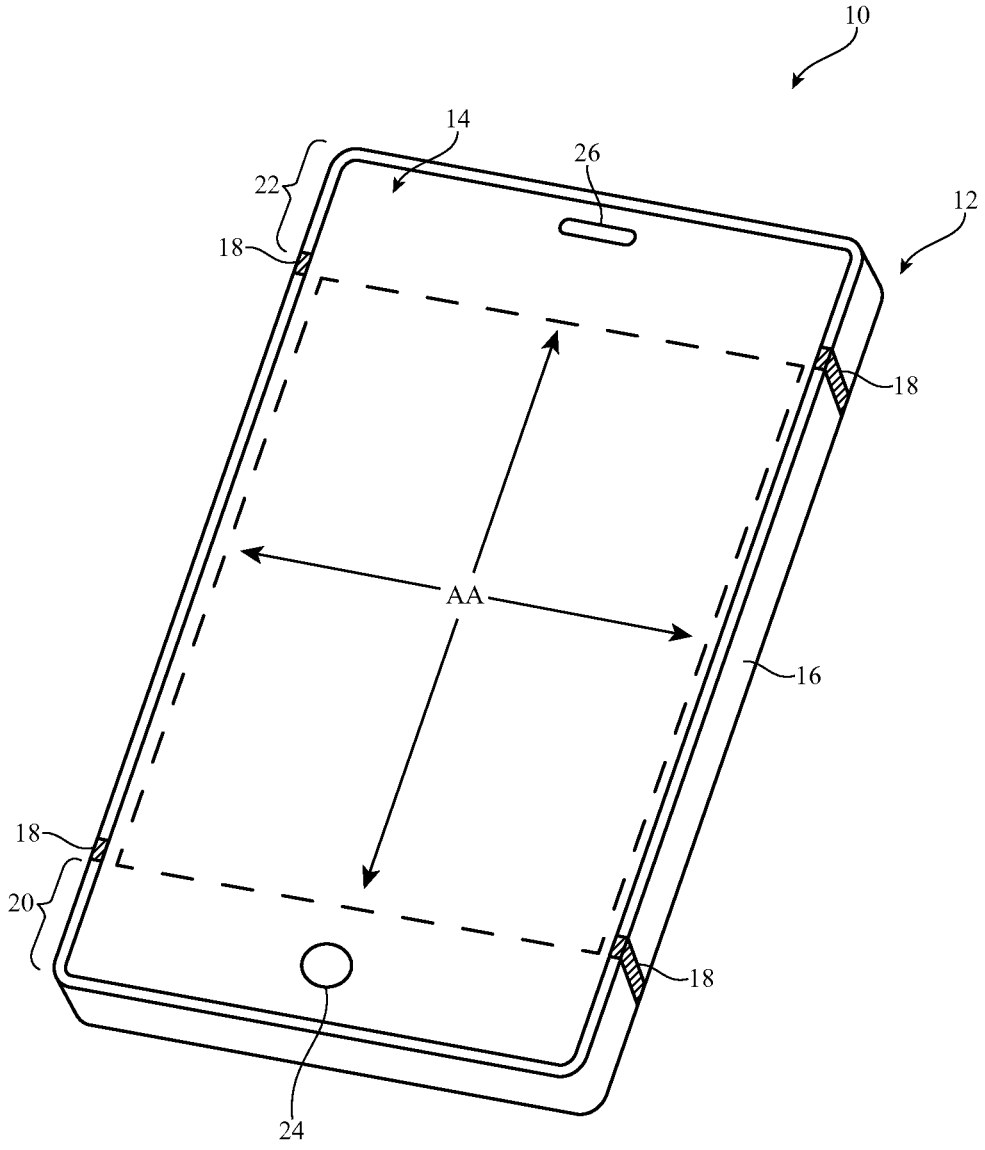
FIG. 1 is a perspective view of an illustrative electronic device with wireless circuitry in accordance with an embodiment.

Electronic devices such as electronic device 10 of FIG. 1 may be provided with wireless communications circuitry. The wireless communications circuitry may be used to support wireless communications in multiple wireless communications bands. The wireless communications circuitry may include one or more antennas.

The antennas can include loop antennas, inverted-F antennas, strip antennas, planar inverted-F antennas, slot antennas, hybrid antennas that include antenna structures of more than one type, or other suitable antennas. Conductive structures for the antennas may, if desired, be formed from conductive electronic device structures. The conductive electronic device structures may include conductive housing structures. The housing structures may include peripheral structures such as a peripheral conductive member that runs around the periphery of an electronic device. The peripheral conductive member may serve as a bezel for a planar structure such as a display, may serve as sidewall structures for a device housing, and/or may form other housing structures. Gaps may be formed in the peripheral conductive member that divide the peripheral conductive member into segments. One or more of the segments may be used in forming one or more antennas for electronic device 10.

Electronic device 10 may be a portable electronic device or other suitable electronic device. For example, electronic device 10 may be a laptop computer, a tablet computer, a somewhat smaller device such as a wrist-watch device, pendant device, headphone device, earpiece device, or other wearable or miniature device, a handheld device such as a cellular telephone, a media player, or other small portable device. Device 10 may also be a television, a set-top box, a desktop computer, a computer monitor into which a computer has been integrated, or other suitable electronic equipment.

Device 10 may include a housing such as housing 12. Housing 12, which may sometimes be referred to as a case, may be formed of plastic, glass, ceramics, fiber composites, metal (e.g., stainless steel, aluminum, etc.), other suitable materials, or a combination of these materials. In some situations, parts of housing 12 may be formed from dielectric or other low-conductivity material. In other situations, housing 12 or at least some of the structures that make up housing 12 may be formed from metal elements.

Device 10 may, if desired, have a display such as display 14. Display 14 may, for example, be a touch screen that incorporates capacitive touch electrodes. Display 14 may include image pixels formed from light-emitting diodes (LEDs), organic LEDs (OLEDs), plasma cells, electrowetting pixels, electrophoretic pixels, liquid crystal display (LCD) components, or other suitable image pixel structures.

A display cover layer such as a layer of clear glass or plastic may cover the surface of display 14. Buttons such as button 24 may pass through openings in the cover layer. The cover layer may also have other openings such as an opening for speaker port 26.

Housing 12 may include peripheral housing structures such as structures 16. Structures 16 may run around the periphery of device 10 and display 14. In configurations in which device 10 and display 14 have a rectangular shape with four edges, structures 16 may be implemented using a peripheral housing member have a rectangular ring shape with four corresponding edges (as an example). Peripheral structures 16 or part of peripheral structures 16 may serve as a bezel for display 14 (e.g., a cosmetic trim that surrounds all four sides of display 14 and/or helps hold display 14 to device 10). Peripheral structures 16 may also, if desired, form sidewall structures for device 10 (e.g., by forming a metal band with vertical sidewalls, etc.).

Peripheral housing structures 16 may be formed of a conductive material such as metal and may therefore sometimes be referred to as peripheral conductive housing structures, conductive housing structures, peripheral metal structures, or a peripheral conductive housing member (as examples). Peripheral housing structures 16 may be formed from a metal such as stainless steel, aluminum, or other suitable materials. One, two, or more than two separate structures may be used in forming peripheral housing structures 16.

It is not necessary for peripheral housing structures 16 to have a uniform cross-section. For example, the top portion of peripheral housing structures 16 may, if desired, have an inwardly protruding lip that helps hold display 14 in place. If desired, the bottom portion of peripheral housing structures 16 may also have an enlarged lip (e.g., in the plane of the rear surface of device 10). In the example of FIG. 1, peripheral housing structures 16 have substantially straight vertical sidewalls. This is merely illustrative. The sidewalls formed by peripheral housing structures 16 may be curved or may have other suitable shapes. In some configurations (e.g., when peripheral housing structures 16 serve as a bezel for display 14), peripheral housing structures 16 may run around the lip of housing 12 (i.e., peripheral housing structures 16 may cover only the edge of housing 12 that surrounds display 14 and not the rest of the sidewalls of housing 12).

If desired, housing 12 may have a conductive rear surface. For example, housing 12 may be formed from a metal such as stainless steel or aluminum. The rear surface of housing 12 may lie in a plane that is parallel to display 14. In configurations for device 10 in which the rear surface of housing 12 is formed from metal, it may be desirable to form parts of peripheral conductive housing structures 16 as integral portions of the housing structures forming the rear surface of housing 12. For example, a rear housing wall of device 10 may be formed from a planar metal structure and portions of peripheral housing structures 16 on the left and right sides of housing 12 may be formed as vertically extending integral metal portions of the planar metal structure. Housing structures such as these may, if desired, be machined from a block of metal.

Display 14 may include conductive structures such as an array of capacitive electrodes, conductive lines for addressing pixel elements, driver circuits, etc. Housing 12 may include internal structures such as metal frame members, a planar housing member (sometimes referred to as a midplate) that spans the walls of housing 12 (i.e., a substantially rectangular sheet formed from one or more parts that is welded or otherwise connected between opposing sides of member 16), printed circuit boards, and other internal conductive structures. These conductive structures, which may be used in forming a ground plane in device 10, may be located in the center of housing 12 under active area AA of display 14 (e.g., the portion of display 14 that contains circuitry and other structures for displaying images).

In regions 22 and 20, openings may be formed within the conductive structures of device 10 (e.g., between peripheral conductive housing structures 16 and opposing conductive ground structures such as conductive housing midplate or rear housing wall structures, a printed circuit board, and conductive electrical components in display 14 and device 10). These openings, which may sometimes be referred to as gaps, may be filled with air, plastic, and other dielectrics.

Conductive housing structures and other conductive structures in device 10 such as a midplate, traces on a printed circuit board, display 14, and conductive electronic components may serve as a ground plane for the antennas in device 10. The openings in regions 20 and 22 may serve as slots in open or closed slot antennas, may serve as a central dielectric region that is surrounded by a conductive path of materials in a loop antenna, may serve as a space that separates an antenna resonating element such as a strip antenna resonating element or an inverted-F antenna resonating element from the ground plane, may contribute to the performance of a parasitic antenna resonating element, or may otherwise serve as part of antenna structures formed in regions 20 and 22. If desired, extensions of the ground plane under active area AA of display 14 and/or other metal structures in device 10 may have portions that extend into parts of the dielectric-filled openings in regions 20 and 22.

In general, device 10 may include any suitable number of antennas (e.g., one or more, two or more, three or more, four or more, etc.). The antennas in device 10 may be located at opposing first and second ends of an elongated device housing (e.g., at ends 20 and 22 of device 10 of FIG. 1), along one or more edges of a device housing, in the center of a device housing, in other suitable locations, or in one or more of such locations. The arrangement of FIG. 1 is merely illustrative.

Portions of peripheral housing structures 16 may be provided with gap structures. For example, peripheral housing structures 16 may be provided with one or more gaps such as gaps 18, as shown in FIG. 1. The gaps in peripheral housing structures 16 may be filled with dielectric such as polymer, ceramic, glass, air, other dielectric materials, or combinations of these materials. Gaps 18 may divide peripheral housing structures 16 into one or more peripheral conductive segments. There may be, for example, two peripheral conductive segments in peripheral housing structures 16 (e.g., in an arrangement with two gaps), three peripheral conductive segments (e.g., in an arrangement with three gaps), four peripheral conductive segments (e.g., in an arrangement with four gaps, etc.). The segments of peripheral conductive housing structures 16 that are formed in this way may form parts of antennas in device 10.

In a typical scenario, device 10 may have upper and lower antennas (as an example). An upper antenna may, for example, be formed at the upper end of device 10 in region 22. A lower antenna may, for example, be formed at the lower end of device 10 in region 20. The antennas may be used separately to cover identical communications bands, overlapping communications bands, or separate communications bands. The antennas may be used to implement an antenna diversity scheme or a multiple-input-multiple-output (MIMO) antenna scheme.

Antennas in device 10 may be used to support any communications bands of interest. For example, device 10 may include antenna structures for supporting local area network communications, voice and data cellular telephone communications, global positioning system (GPS) communications or other satellite navigation system communications, Bluetooth® communications, etc.

Figure 2:
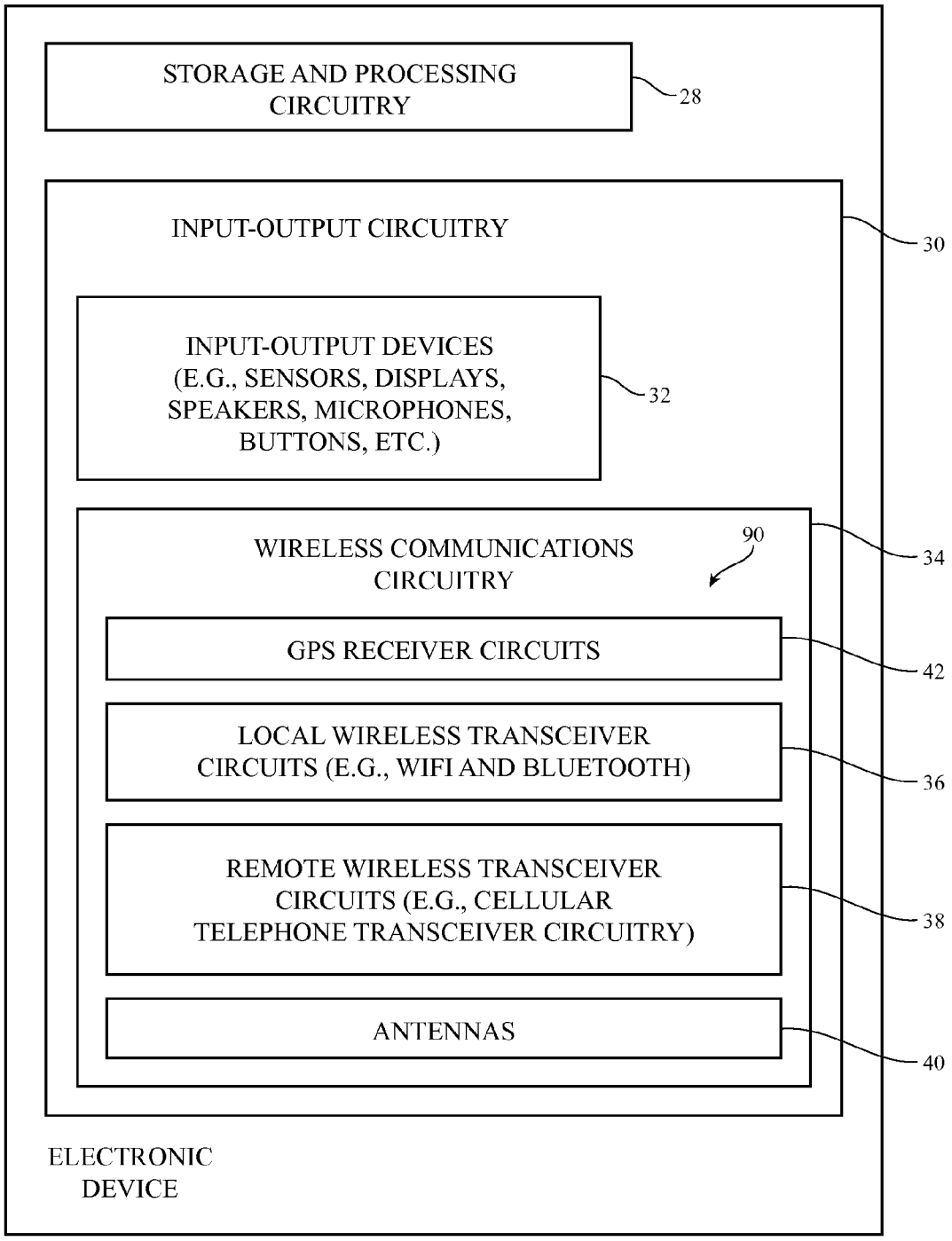
FIG. 2 is a schematic diagram of illustrative circuitry in an electronic device in accordance with an embodiment.

A schematic diagram showing illustrative components that may be used in device 10 of FIG. 1 is shown in FIG. 2. As shown in FIG. 2, device 10 may include control circuitry such as storage and processing circuitry 28. Storage and processing circuitry 28 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 28 may be used to control the operation of device 10. This processing circuitry may be based on one or more microprocessors, microcontrollers, digital signal processors, application specific integrated circuits, etc.

Storage and processing circuitry 28 may be used to run software on device 10, such as internet browsing applications, voice-over-internet-protocol (VOIP) telephone call applications, email applications, media playback applications, operating system functions, etc. To support interactions with external equipment, storage and processing circuitry 28 may be used in implementing communications protocols. Communications protocols that may be implemented using storage and processing circuitry 28 include internet protocols, wireless local area network protocols (e.g., IEEE 802.11 protocols—sometimes referred to as WiFi®), protocols for other short-range wireless communications links such as the Bluetooth® protocol, cellular telephone protocols, MIMO protocols, antenna diversity protocols, etc.

Input-output circuitry 30 may include input-output devices 32. Input-output devices 32 may be used to allow data to be supplied to device 10 and to allow data to be provided from device 10 to external devices. Input-output devices 32 may include user interface devices, data port devices, and other input-output components. For example, input-output devices may include touch screens, displays without touch sensor capabilities, buttons, joysticks, click wheels, scrolling wheels, touch pads, key pads, keyboards, microphones, cameras, buttons, speakers, status indicators, light sources, audio jacks and other audio port components, digital data port devices, light sensors, motion sensors (accelerometers), capacitance sensors, proximity sensors, etc.

Input-output circuitry 30 may include wireless communications circuitry 34 for communicating wirelessly with external equipment. Wireless communications circuitry 34 may include radio-frequency (RF) transceiver circuitry formed from one or more integrated circuits, power amplifier circuitry, low-noise input amplifiers, passive RF components, one or more antennas, transmission lines, and other circuitry for handling RF wireless signals. Wireless signals can also be sent using light (e.g., using infrared communications).

Wireless communications circuitry 34 may include radio-frequency transceiver circuitry 90 for handling various radio-frequency communications bands. For example, circuitry 34 may include transceiver circuitry 36, 38, and 42. Transceiver circuitry 36 may handle 2.4 GHz and 5 GHz bands for WiFi® (IEEE 802.11) communications and may handle the 2.4 GHz Bluetooth® communications band. Circuitry 34 may use cellular telephone transceiver circuitry 38 for handling wireless communications in frequency ranges such as a low communications band from 700 to 960 MHz, a midband from 1710 to 2170 MHz, and a high band from 2300 to 2700 MHz or other communications bands between 700 MHz and 2700 MHz or other suitable frequencies (as examples). Circuitry 38 may handle voice data and non-voice data. Wireless communications circuitry 34 can include circuitry for other short-range and long-range wireless links if desired. For example, wireless communications circuitry 34 may include 60 GHz transceiver circuitry, circuitry for receiving television and radio signals, paging system transceivers, near field communications (NFC) circuitry, etc. Wireless communications circuitry 34 may include global positioning system (GPS) receiver equipment such as GPS receiver circuitry 42 for receiving GPS signals at 1575 MHz or for handling other satellite positioning data. In WiFi® and Bluetooth® links and other short-range wireless links, wireless signals are typically used to convey data over tens or hundreds of feet. In cellular telephone links and other long-range links, wireless signals are typically used to convey data over thousands of feet or miles.

Wireless communications circuitry 34 may include antennas 40. Antennas 40 may be formed using any suitable antenna types. For example, antennas 40 may include antennas with resonating elements that are formed from loop antenna structures, patch antenna structures, inverted-F antenna structures, slot antenna structures, planar inverted-F antenna structures, helical antenna structures, hybrids of these designs, etc. Different types of antennas may be used for different bands and combinations of bands. For example, one type of antenna may be used in forming a local wireless link antenna and another type of antenna may be used in forming a remote wireless link antenna.

Figure 3:
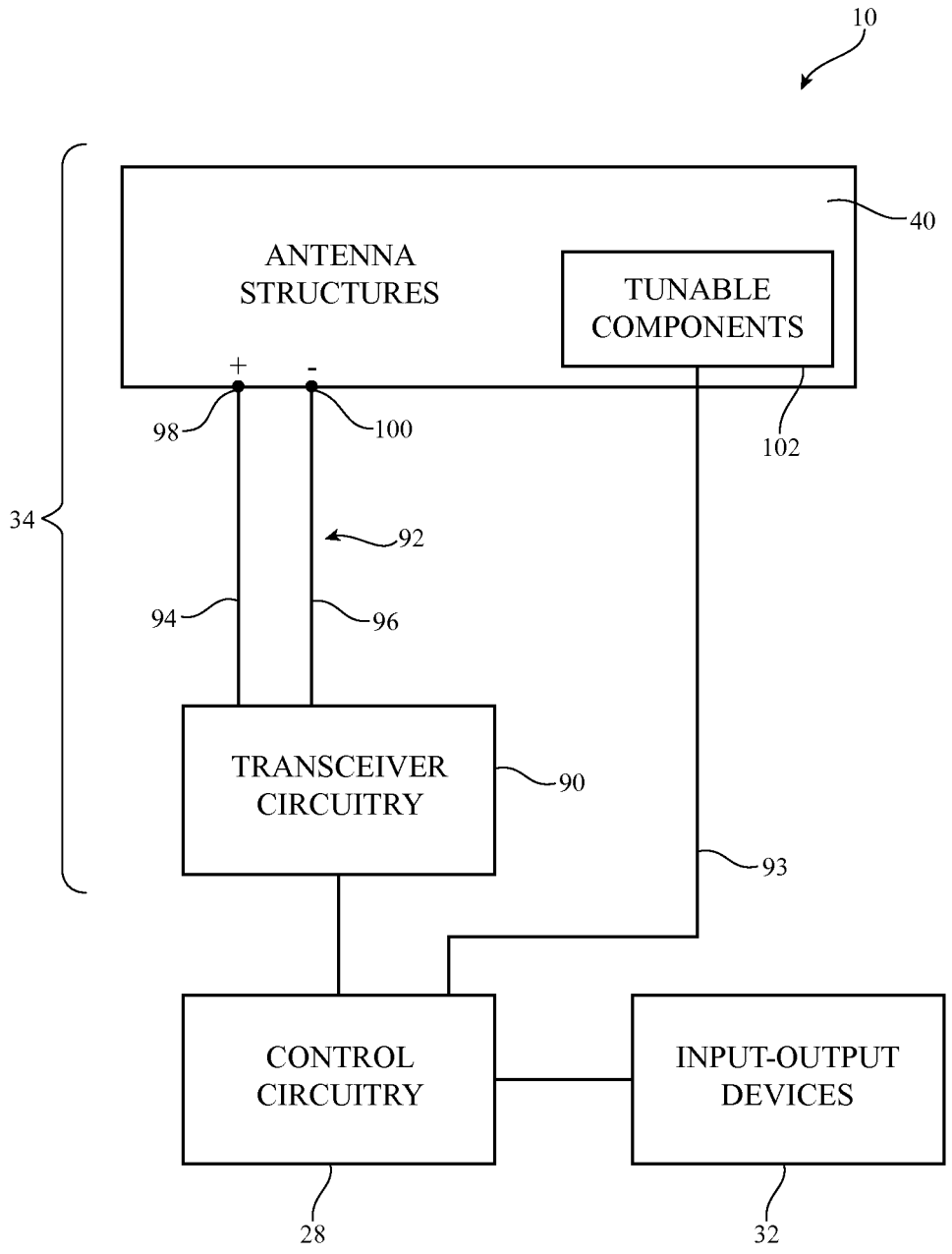
FIG. 3 is a schematic diagram of illustrative wireless circuitry in accordance with an embodiment.

As shown in FIG. 3, transceiver circuitry 90 in wireless circuitry 34 may be coupled to antenna structures 40 using paths such as path 92. Wireless circuitry 34 may be coupled to control circuitry 28. Control circuitry 28 may be coupled to input-output devices 32. Input-output devices 32 may supply output from device 10 and may receive input from sources that are external to device 10.

To provide antenna structures 40 with the ability to cover communications frequencies of interest, antenna structures 40 may be provided with circuitry such as filter circuitry (e.g., one or more passive filters and/or one or more tunable filter circuits). Discrete components such as capacitors, inductors, and resistors may be incorporated into the filter circuitry. Capacitive structures, inductive structures, and resistive structures may also be formed from patterned metal structures (e.g., part of an antenna). If desired, antenna structures 26 may be provided with adjustable circuits such as tunable components 102 to tune antennas over communications bands of interest. Tunable components 102 may include tunable inductors, tunable capacitors, or other tunable components. Tunable components such as these may be based on switches and networks of fixed components, distributed metal structures that produce associated distributed capacitances and inductances, variable solid state devices for producing variable capacitance and inductance values, tunable filters, or other suitable tunable structures. During operation of device 10, control circuitry 28 may issue control signals on one or more paths such as path 93 that adjust inductance values, capacitance values, or other parameters associated with tunable components 102, thereby tuning antenna structures 40 to cover desired communications bands.

Path 92 may include one or more transmission lines. As an example, signal path 92 of FIG. 3 may be a transmission line having a positive signal conductor such as line 94 and a ground signal conductor such as line 96. Lines 94 and 96 may form parts of a coaxial cable or a microstrip transmission line (as examples). A matching network formed from components such as inductors, resistors, and capacitors may be used in matching the impedance of antenna structures 40 to the impedance of transmission line 92. Matching network components may be provided as discrete components (e.g., surface mount technology components) or may be formed from housing structures, printed circuit board structures, traces on plastic supports, etc. Components such as these may also be used in forming filter circuitry in antenna structures 40.

Transmission line 92 may be coupled to antenna feed structures associated with antenna structures 40. As an example, antenna structures 40 may form an inverted-F antenna, a slot antenna, a hybrid inverted-F slot antenna or other antenna having an antenna feed with a positive antenna feed terminal such as terminal 98 and a ground antenna feed terminal such as ground antenna feed terminal 100. Positive transmission line conductor 94 may be coupled to positive antenna feed terminal 98 and ground transmission line conductor 96 may be coupled to ground antenna feed terminal 92. Other types of antenna feed arrangements may be used if desired. The illustrative feeding configuration of FIG. 3 is merely illustrative.

Figure 4:
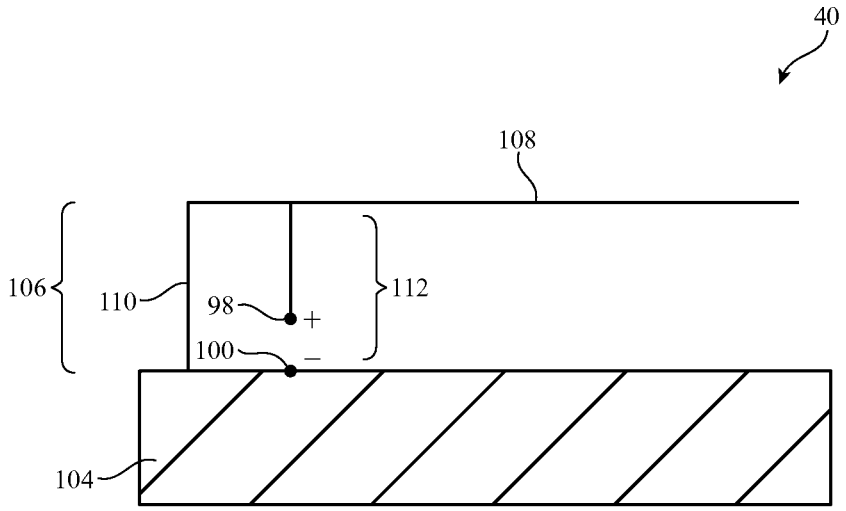
FIG. 4 is a schematic diagram of an illustrative inverted-F antenna in accordance with an embodiment.

FIG. 4 is a diagram of illustrative inverted-F antenna structures that may be used in implementing antenna 40 for device 10. Inverted-F antenna 40 of FIG. 4 has antenna resonating element 106 and antenna ground (ground plane) 104. Antenna resonating element 106 may have a main resonating element arm such as arm 108. The length of arm 108 may be selected so that antenna 40 resonates at desired operating frequencies. For example, if the length of arm 108 may be a quarter of a wavelength at a desired operating frequency for antenna 40. Antenna 40 may also exhibit resonances at harmonic frequencies.

Main resonating element arm 108 may be coupled to ground 104 by return path 110. Antenna feed 112 may include positive antenna feed terminal 98 and ground antenna feed terminal 100 and may run in parallel to return path 110 between arm 108 and ground 104. If desired, inverted-F antennas such as illustrative antenna 40 of FIG. 4 may have more than one resonating arm branch (e.g., to create multiple frequency resonances to support operations in multiple communications bands) or may have other antenna structures (e.g., parasitic antenna resonating elements, tunable components to support antenna tuning, etc.).

Figure 5:
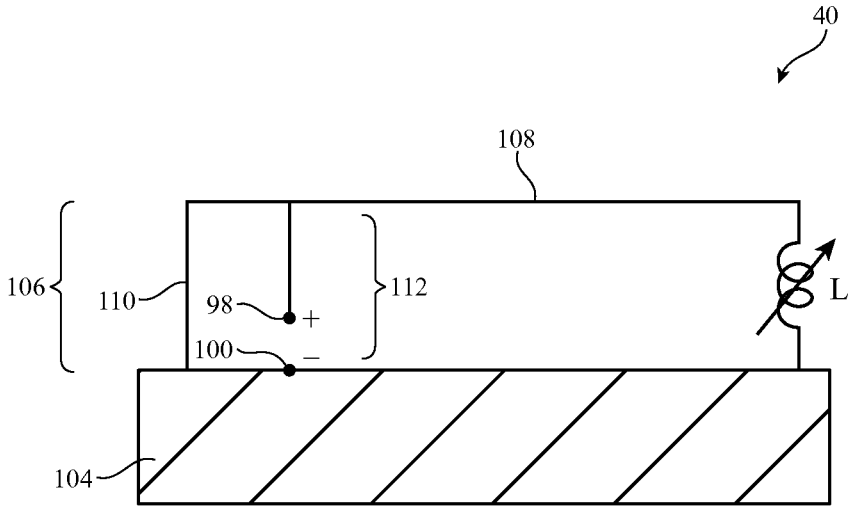
FIG. 5 is a schematic diagram of an illustrative inverted-F antenna with an inductor to tune the antenna to cover desired operating frequencies in accordance with an embodiment.

FIG. 5 is a diagram of an illustrative inverted-F antenna configuration of the type that may be used to implement a tunable antenna. As shown in FIG. 5, antenna 40 may be provided with an inductor L that couples a portion of antenna resonating element arm 108 (e.g., a tip of arm 108) in resonating element 106 to antenna ground 104. Inductor L may be a variable inductor. For example, inductor L may be an adjustable inductor that is formed from one or more transistor or other switching circuitry and a set of fixed inductors. During operation of device 10, control circuitry 28 can issue control signals that adjust the switching circuitry (e.g., that open and close transistor switches in the switching circuitry), thereby switching desired patterns of the set of fixed inductors into and out of use to adjust the inductance value of inductor L. Adjustments such as these may be made to vary the inductance of inductor L when it is desired to tune the frequency response of antenna 40 (e.g., when it is desired to tune the low band resonance of antenna 40, when it is desired to tune a mid-band resonance of antenna 40, etc.). For example, increases to the value of L may be made to increase the frequency of the communications band(s) in which antenna 40 is operating (e.g., to increase a low-band resonant frequency or a mid-band resonant frequency). One or more inductors such as inductor L may be coupled between arm 108 and ground 104 at one or more locations along the length of arm 108. The configuration of FIG. 5 is illustrative.

Figure 6:
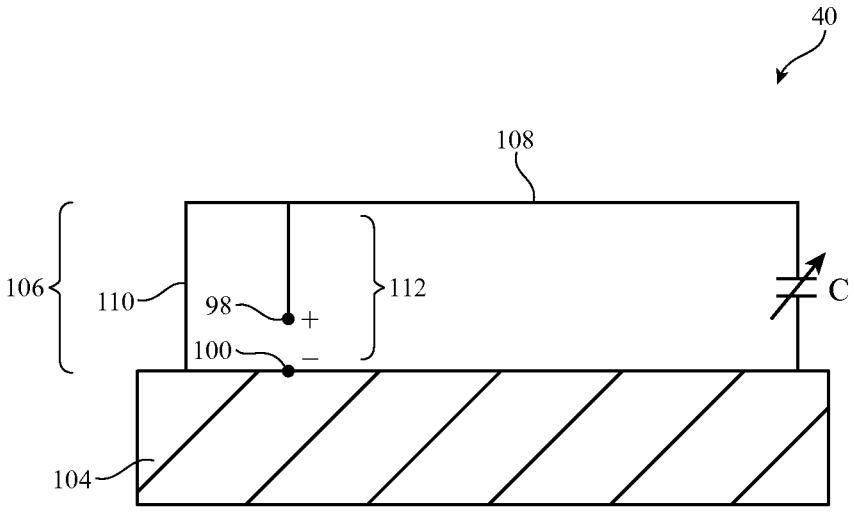
FIG. 6 is a schematic diagram of an illustrative inverted-F antenna with a capacitor to tune the antenna to cover desired operating frequencies in accordance with an embodiment.

FIG. 6 is a diagram of an illustrative inverted-F antenna structure with a capacitor that may be used to implement a tunable antenna. As shown in FIG. 6, antenna 40 may be provided with a capacitor C that couples a tip portion of antenna resonating element arm 108 in resonating element 106 to antenna ground 104. Capacitors such as capacitor C may also be coupled to arm 108 at other locations. Capacitor C may be a fixed capacitor or may be a variable capacitor. For example, capacitor C may be formed from one or more switches or other switching circuitry and a set of fixed capacitors (e.g., a programmable capacitor) or a varactor. During operation of device 10, control circuitry 28 can issue control signals that open and close switches in the switching circuitry to switch desired capacitors into and out of use or that otherwise make adjustments to capacitor C, thereby varying the capacitance value exhibited by capacitor C. Adjustments such as these may be made to vary the capacitance of capacitance C when it is desired to tune the frequency response of antenna 40 (e.g., when it is desired to tune the low band resonance of antenna 40, when it is desired to tune a mid-band resonance of antenna 40, or when it is desired to tune a high band resonance of antenna 40). For example, increases to the value of C may be made to decrease the frequency range of the communications band(s) in which antenna 40 is operating (e.g., to decrease a high-band resonant frequency). Capacitor C need not be located at the tip of arm 108. For example, the resonant frequency decrease associated with inclusion of capacitor C in antenna 40 can be enhanced by locating capacitor C closer to feed 112. If desired, antenna 40 can be implemented using a pair of fixed capacitances C (e.g., fixed capacitances associated with gaps 18 at either end of a two-branch inverted-F antenna resonating element formed from a peripheral conductive structure such as a segment of peripheral structure 16) and variable capacitors can be omitted (as an example).

In general, antenna 40 may have one or more adjustable components (adjustable inductors, adjustable capacitors, etc.). The configurations of FIGS. 5 and 6 are merely illustrative.

Figure 7:
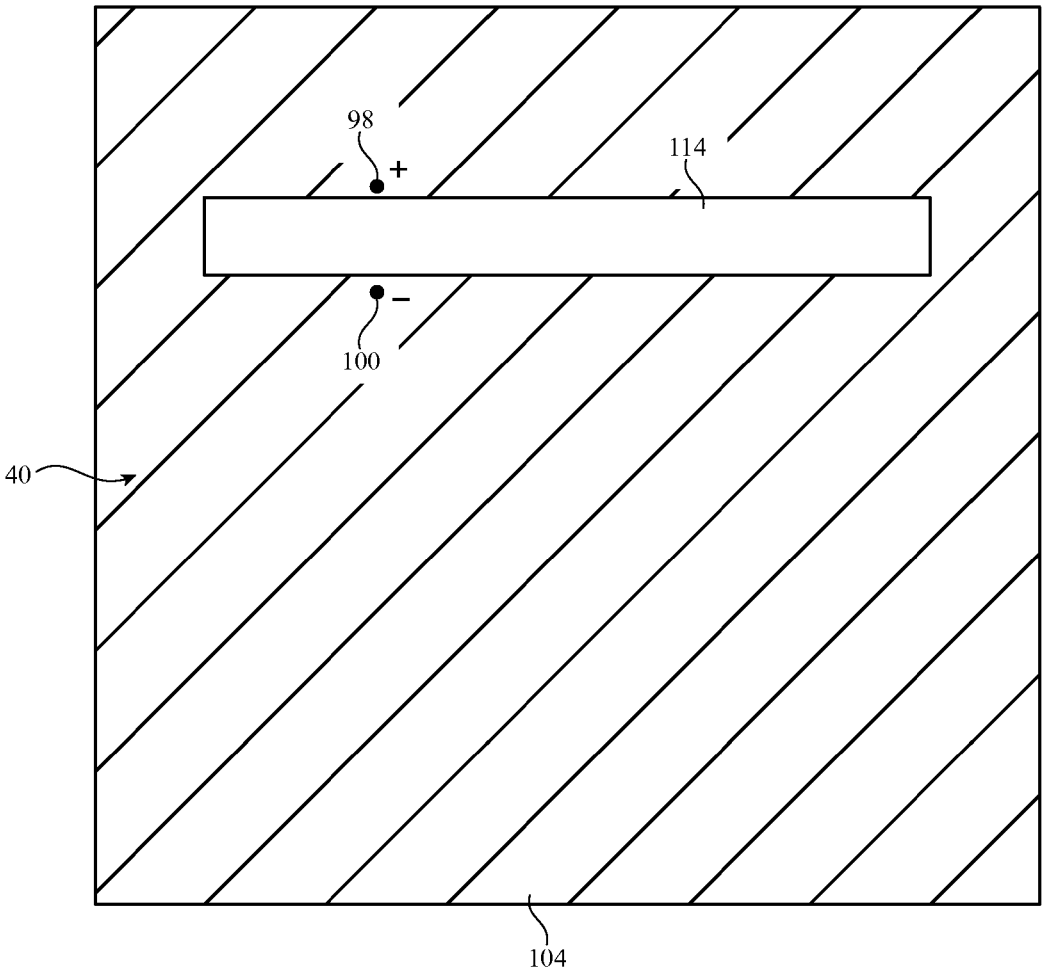
FIG. 7 is a diagram of an illustrative slot antenna in accordance with an embodiment of the present invention.

Antenna 40 may include a slot antenna resonating element. As shown in FIG. 7, for example, antenna 40 may be a slot antenna having an opening such as slot 114 that is formed within antenna ground 104. Slot 114 may be filled with air, plastic, and/or other dielectric. The shape of slot 114 may be straight or may have one or more bends (i.e., slot 114 may have an elongated shape follow a meandering path). The antenna feed for antenna 40 may include positive antenna feed terminal 98 and ground antenna feed terminal 100. Feed terminals 98 and 100 may, for example, be located on opposing sides of slot 114 (e.g., on opposing long sides). Slot-based antenna resonating elements such as slot antenna resonating element 114 of FIG. 7 may give rise to an antenna resonance at frequencies in which the wavelength of the antenna signals is equal to the perimeter of the slot. In narrow slots, the resonant frequency of a slot antenna resonating element is associated with signal frequencies at which the slot length is equal to a half of a wavelength. Slot antenna frequency response can be tuned using one or more tunable components such as tunable inductors or tunable capacitors. These components may have terminals that are coupled to opposing sides of the slot (i.e., the tunable components may bridge the slot). If desired, tunable components may have terminals that are coupled to respective locations along the length of one of the sides of slot 114. Combinations of these arrangements may also be used.

If desired, antenna 40 may incorporate conductive device structures such as portions of housing 12. As an example, peripheral conductive housing structures 16 may include multiple segments such as segments 16-1, 16-2, and 16-3 of FIG. 8 that are separated from each other by gaps 18 (e.g., spaces between the adjoining ends of the segments that are filled with plastic or other dielectric). In antenna 40 of FIG. 8, segment 16-1 may be formed from a strip of stainless steel or other metal that forms a segment of a peripheral conductive housing member (e.g., a stainless steel member or other peripheral metal housing structure) that runs around the entire periphery of device 10.

Segment 16-1 may form antenna resonating arm 108 for an inverted-F antenna. For example, segment 16-1 may form a dual-band inverted-F antenna resonating element having a longer branch that contributes an antenna response in a low frequency communications band (low band LB) and having a shorter branch that contributes an antenna response in a middle frequency communications band (middle band MB). Dual-band inverted-F antenna structures of this type may sometimes be referred to as T-shaped antennas or T-antennas. A return path conductor such as a strip of metal may be used to form return path 110 between peripheral conductive segment 16-1 (i.e., the main resonating element arm of the T-antenna resonating element) and antenna ground 104.

Antenna ground 104 may have ground structures such as a substantially rectangular antenna ground plane portion in the center of device 10 (e.g., the portion of device underlying active area AA of display 14 of FIG. 1). Antenna ground 104 may also have a portion such as ground plane extension 104E that extends outwards from the main antenna ground region in device 10. Ground plane extension 104E may protrude into an end region of device 10 such as lower end region 20. Ground plane extension 104E of antenna ground 104 may be separated from the main portion of antenna ground 104 and peripheral segment 16-1 by an opening that forms antenna slot 114. Antenna slot 114 may be fed using antenna feed 112 (i.e., using antenna feed terminals on opposing sides of slot 114 such as positive antenna feed terminal 98 and ground antenna feed terminal 100). The magnitude of the periphery of antenna slot 114 may determine the frequency at which slot 114 resonances and may therefore be used to produce a desired resonance for antenna (e.g., a high band resonance HB that complements low band resonance LB and midband resonance MB associated with the T-antenna formed from segment 16-1).

When operating antenna 40 in device 10, both the T-antenna formed from segment 16-1 of peripheral conductive housing structures 16 (i.e., the inverted-F antenna) and the slot antenna formed from slot 114 may contribute to the overall response of the antenna. Because two different types of antenna contribute to the operation of antenna 40 (i.e., the inverted-F antenna portion and the slot antenna portion), antenna 40 may sometimes be referred to as a hybrid inverted-F slot antenna or hybrid antenna.

If desired, optional electrical components such as inductors and/or capacitors may be coupled to antenna 40. For example, one or more inductors such as inductors L1, L2, and L3 may bridge slot 114 or may be coupled to different locations along the periphery of slot 114 and/or one or more capacitors may bridge slot 114 or may be coupled to different locations along the periphery of slot 114. Capacitances may be formed by discrete components (capacitors) or may be produced by the metal structures of FIG. 8. For example, the metal portions of peripheral conductive structures 16 that are separated by gaps 18 from ground 104 may produce capacitances at the left and right ends of resonating element 108. Inductor L1 may bridge the left-hand gap 18 and may help compensate for the capacitance associated with the left-hand gap 18. Inductor L3 may bridge the right-hand gap 18 and may help compensate for the capacitance associated with the right-hand gap 18.

Inductor L2 may be an adjustable inductor that can be adjusted by control circuitry 28 to produce various different inductance values. For example, inductor L2 may include two parallel inductors and an associated silicon-on-insulator (SOI) high speed silicon metal oxide-semiconductor switch (e.g., a switch with a pair of field-effect transistors). In response to control signals on path 93, the switch of inductor L2 may switch both inductors into use, may switch a selected one of the inductors into use, or may switch both inductors out of use. Configurations with larger numbers of fixed inductors and corresponding larger numbers of transistors to perform switching operations for the switch may also be used.

Device 10 may include connectors for data ports and other electrical components. One or more of these electrical components may be mounted in housing 12 in a position that minimizes interference with antenna 40. For example, a data port connector or other electrical component may be mounted in device 10 in a location such as location 116 that overlaps ground plane extension 104E.

The size and shape of conductive antenna structures such as inverted-F antenna resonating element 108, slot antenna resonating element 114 and ground 104 affect the frequency response of antenna 40.

With one suitable arrangement, antenna 40 may exhibit low band (LB), midband (MB), and high band (HB) antenna resonances. The antenna resonance that is associated with low band LB may be generated by the longer of the two branches of inverted-F resonating element arm 108, the antenna resonance that is associated with middle band MB may be produced partly by the shorter branch of inverted-F arm 108 and partly by slot 114 (or just by the shorter branch), and the antenna resonance that is associated with high band HB may be produced partly by slot antenna 114 and partly by a harmonic of low band LB. Tunable inductor L2 may be used to tune low band LB. Other inductors and/or capacitors (see, e.g., inductors L1 and L3, etc.) may, if desired, be adjusted to tune antenna performance.

Tunable inductor L2 may have multiple states. For example, tunable inductor L2 may include a switch that allows inductor L2 to be placed in multiple states so that antenna 40 exhibits four corresponding frequency responses or other suitable number of frequency responses.

Figure 9:
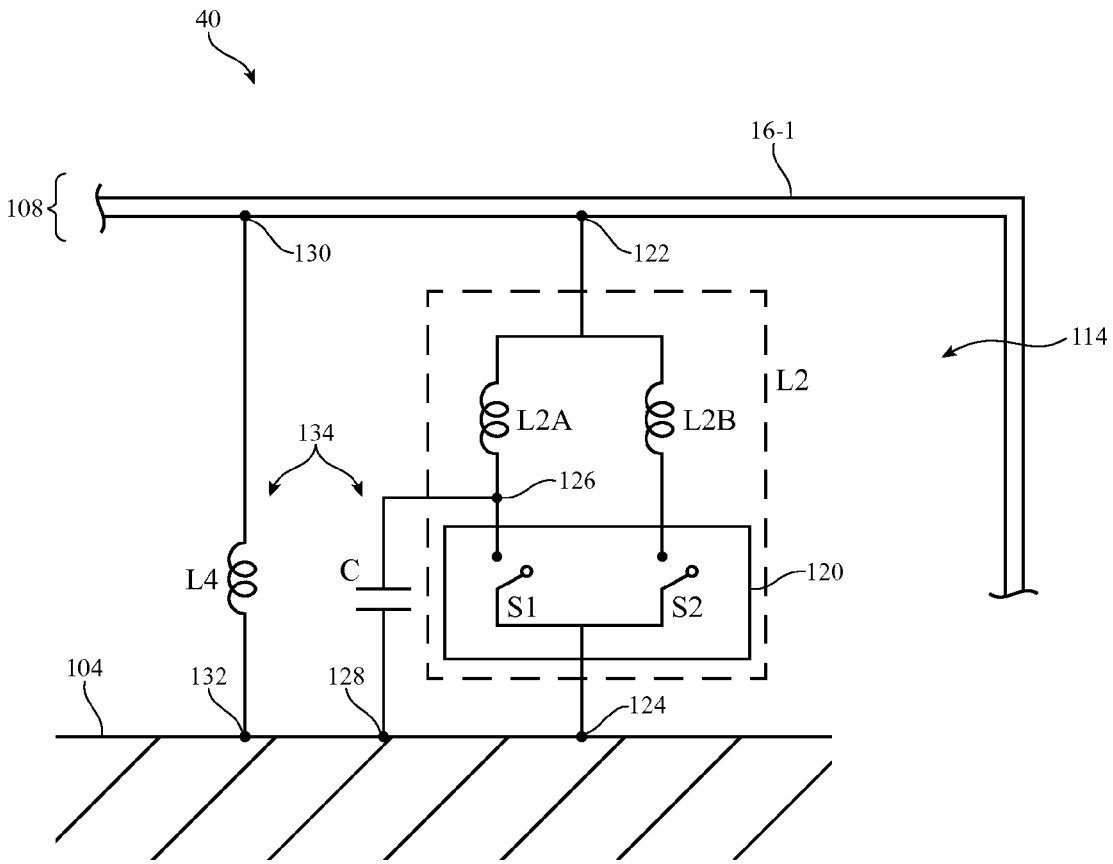
FIG. 9 is a diagram of illustrative circuitry that may be used in an antenna such as the antenna of FIG. 8 or other suitable antenna to reduce lossy mode operation and thereby enhance performance over a range of operating frequencies in accordance with an embodiment.

Consider, as an example, inductor L2 of FIG. 9. As shown in FIG. 9, inductor L2 may contain two inductors coupled in parallel: inductor L2A and inductor L2B. Adjustable inductor L2 may also have switching circuitry such as switch 120. Switch 120 may be a semiconductor switch (e.g., a switch having two silicon-on-insulator field-effect transistors S1 and S2 or other suitable transistor-based switch). Inductor L2 may be coupled between resonating element 108 and antenna ground 104. For example, inductor L2A may be coupled between a first port of switch 120 and resonating element 108 (e.g., node 122 on peripheral conductive structures 16-1). Inductor L2B may be coupled between a second port of switch 120 and resonating element 108 (e.g., node 122 on peripheral conductive structures 16-1). Switch 120 has a third port that is coupled to antenna ground 104 at node 124.

During operation, control signals (e.g., control signals on a path such as path 93 of FIG. 3) may be used to adjust the state of switch 120. Inductor L2A may have a value of 12 nH or other suitable value (e.g., less than 20 nH, 5-20 nH, more than 3 nH, etc.). Inductor L2B may have a value of 51 nH or other suitable value (e.g., less than 60 nH, less than 100 nH, more than 20 nH, more than 40 nH, between 40-100 nH, etc.).

Switch 120 may be placed in one of four different modes, corresponding to four different tunings for antenna 40. In the first mode, the transistor switches S1 and S2 of switch 120 are both open, so that the first and second switch ports are isolated from the third switch port. In this scenario, both inductors L2A and L2B are switched out of use and the impedance of adjustable inductor L2 between nodes 122 and 124 is ideally infinite. In a second mode, transistor S1 is open and transistor S2 is closed. In this scenario, the inductance of inductor L2 may be about 51 nH. In a third mode, the transistors in switch 120 are configured so that S1 is closed and S2 is open to switch inductor L2A into use and switch inductor L2B out of use. In this scenario, the inductance of inductor L2 may be about 12 nH. In a fourth mode, the transistors in switch 120 are configured to switch both inductor L2A and inductor L2B into use (i.e., both S1 and S2 are closed), so the impedance of adjustable inductor L2 has a fourth value (about 9.7 nH).

Switch 120 may be characterized by parasitics such as a capacitance Coff when the first and second ports are isolated from the third port and such as an "on resistance" Ron when the first and second ports are connected to the third port. The product of Coff and Ron may be about 200 fs.

The parasitic characteristics of switch 120 can influence antenna performance. Modelling results have shown that an antenna such as antenna 40 of FIG. 8 that includes a tunable inductor such as inductor L2 (e.g., an adjustable inductor with a field-effect transistor switch such as switch 120) will be prone to losses (lossy mode operation) in the two modes of operation in which inductor L2A is switched into use. These losses reduce antenna efficiency. The reduction in antenna efficiency, which may appear, for example, at operating frequencies of about 2 to 2.4 GHz, can be reduced or even eliminated by including capacitor C and inductor L4 in antenna 40, as shown in FIG. 9. Capacitor C may be coupled to inductor L2A. Inductor L4 may be coupled in parallel with inductor L2 between antenna resonating element 108 and ground 104. Inductor L4 and may be located between inductor L2 and the antenna feed formed from positive feed terminal 98 and ground antenna feed terminal 100.

As shown in FIG. 9, capacitor C may be coupled between one of the terminals of the lossy mode inductor (L2A) and ground. Capacitor C may, for example, have a first terminal that is coupled to inductor L2A at one of the ports of switch 120 (node 126) and may have a second terminal that is coupled to antenna ground 104 (node 128). The value of capacitor C may be about 0.3 pF (or other suitable value from 0.1 to 1 pF, more than 0.05 pF, more than 0.2 pF, less than 0.4 pF, less than 1 pF, etc.). Inductor L4 may be coupled between antenna resonating element 108 (e.g., node 130 on peripheral conductive structure 16-1) and antenna ground 104 (e.g., node 132) in parallel with adjustable inductor L2. The value of inductor L4 may be 36 nH or other suitable value (e.g., 10-60 nH, 20-45 nH, more than 5 nH, more than 30 nH, less than 50 nH, less than 60 nH, etc.). Circuit components such as inductor L4 and capacitor C form circuit 134. Circuit 134 may be used to ensure that antenna 40 of FIG. 8 or other suitable antennas with adjustable inductors such as inductor L2 will perform satisfactorily over a range of operating frequencies and will avoid performance degradation due to lossy mode operation. If desired, multiple capacitors may be used to eliminate multiple lossy modes. The example of FIG. 9 is merely illustrative.

Figure 8:
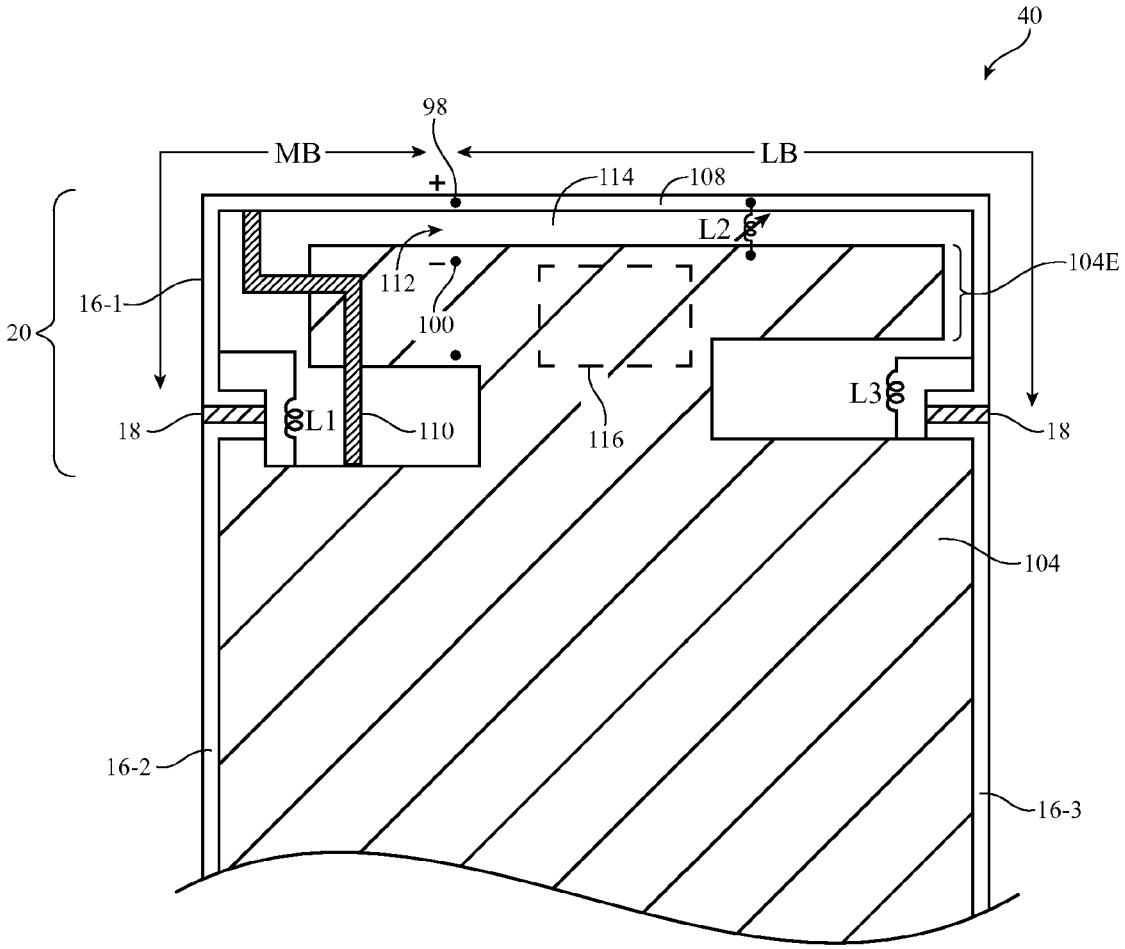
FIG. 8 is a diagram of an illustrative hybrid inverted-F slot antenna in accordance with an embodiment.
Figure 10:
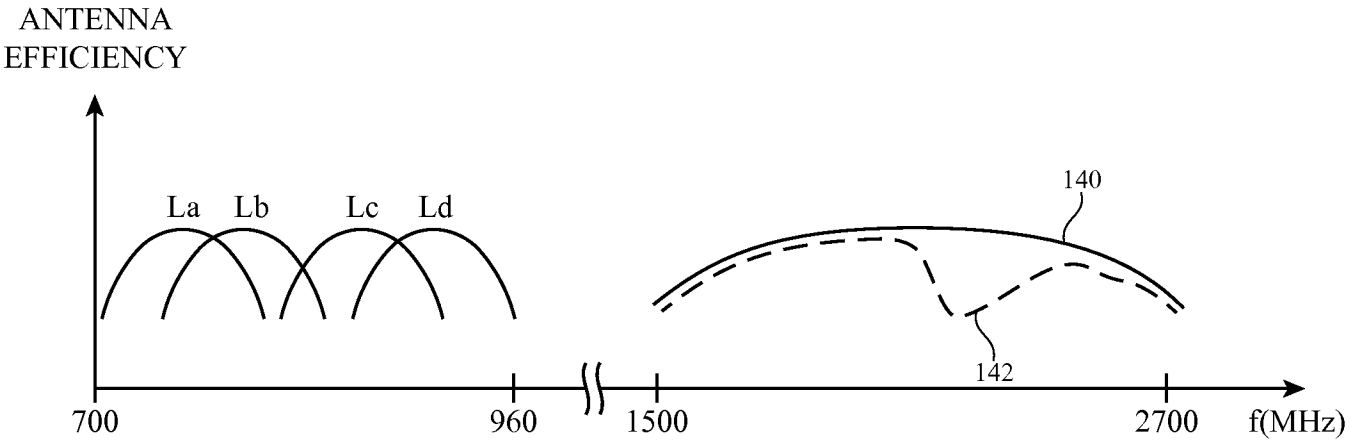
FIG. 10 is a graph in which antenna performance (antenna efficiency) has been plotted as a function of operating frequency for various operating conditions and antenna configurations for an illustrative antenna in accordance with an embodiment.

FIG. 10 is a graph in which antenna performance (antenna efficiency) has been plotted as a function of operating frequency for an illustrative antenna such as antenna 40 of FIG. 8. As shown in FIG. 9, antenna 40 may be configured to cover operating frequencies in a low band (e.g., frequencies from about 700 to 960 MHz) as well as midband and high band frequencies from 1500 to 2700 MHz (as examples).

During operation of device 10, control circuitry may adjust switch 120 to place adjustable inductor L2 in a desired mode, exhibiting inductance values of La (infinite impedance), Lb (51 nH in this example), Lc (12 nH in this example), or Lc (9.7 nH in this example). Each different tuning for adjustable inductor L2 results in a different low band frequency response, as indicated by the antenna resonances labeled La, Lb, Lc, and Ld that are shown in the 700-960 MHz portion of the graph of FIG. 10.

In the Lc and Ld modes, the antenna response of antenna 40 between frequencies 1500 and 2700 MHz is given by solid line 140. This is the normal expected response for antenna 40. In the absence of circuit 134, antenna 40 with adjustable inductor L2 may exhibit undesired reductions in antenna performance at midband frequencies when operated in the La and Lb modes, as indicated by dashed line 142. In the presence of circuit 134, however, antenna 40 performs satisfactorily in the La and Lb modes as well as in the Lc and Ld modes. When circuit 134 is present, antenna performance will therefore be characterized by solid line 140 for all modes La, Lb, Lc, and Ld.

The foregoing is merely illustrative and various modifications can be made by those skilled in the art without departing from the scope and spirit of the described embodiments. The foregoing embodiments may be implemented individually or in any combination.

What is claimed is:

1. Apparatus, comprising:

an antenna resonating element;

an antenna ground;

an adjustable inductor coupled between the antenna resonating element and the antenna ground, wherein the adjustable inductor has a plurality of fixed inductors and a switch;

an inductor coupled between the antenna resonating element and the antenna ground in parallel with the adjustable inductor; and at least one capacitor having a first terminal coupled to one of the fixed inductors at a node between that one of the fixed inductors and the switch and a second terminal coupled to the antenna ground.

2. The apparatus defined in claim 1 wherein the antenna resonating element and antenna ground form an antenna having an antenna feed with a positive antenna feed terminal and a ground antenna feed terminal and wherein the inductor is coupled between the antenna resonating element and the antenna ground at a location between the adjustable inductor and the antenna feed.

3. The apparatus defined in claim 2 wherein the plurality of fixed inductors includes first and second inductors coupled to respective first and second ports in the switch, wherein the switch has a third port, and wherein the switch operates in a first mode in which the first and second inductors are switched out of use, a second mode in which the first inductor is switched out of use and the second inductor is switched into use, a third mode in which the first inductor is switched into use and the second inductor is switched out of use, and a fourth mode in which the first and second inductors are switched into use.

4. The apparatus defined in claim 3 wherein the one of the fixed inductors to which the capacitor is coupled is the first inductor, wherein the first inductor has a first terminal coupled to the antenna resonating element, wherein the first inductor has a second terminal coupled to the first port at the node, and wherein the first terminal of the capacitor is coupled to the second terminal of the first inductor.

5. The apparatus defined in claim 4 further comprising an electronic device housing having peripheral conductive structures, wherein the antenna resonating element is formed from at least part of the peripheral conductive structures.

6. The apparatus defined in claim 5 wherein the resonating element comprises an inverted-F antenna resonating element.

7. The apparatus defined in claim 6 wherein the antenna comprises a hybrid inverted-F slot antenna having a slot antenna resonating element.

8. The apparatus defined in claim 4 wherein the first inductor and the second inductor have different respective inductance values.

9. The apparatus defined in claim 8 wherein the antenna resonating element comprises a peripheral conductive electronic device housing structure running along at least one peripheral edge of an electronic device.

10. The apparatus defined in claim 1 wherein the antenna resonating element has first and second branches, wherein the adjustable inductor is coupled between the second branch and the antenna ground, wherein an antenna feed is coupled to the antenna resonating element, and wherein the inductor is coupled between the antenna resonating element and the antenna ground at a location that is between the antenna feed and the adjustable inductor.

11. The apparatus defined in claim 10 further comprising control circuitry that issues control signals to adjustable inductor to tune the antenna when the antenna is operating at a frequency between 700 and 960 MHz.

12. An antenna, comprising:

an antenna ground;

an antenna resonating element separated from the antenna ground by a gap;

an antenna feed having a positive antenna feed terminal coupled to the antenna resonating element and a ground antenna feed terminal coupled to the antenna ground;

an adjustable inductor circuit having first and second inductors and a switch coupled to the first and second inductors at respective first and second ports, wherein the adjustable inductor circuit is coupled between the antenna resonating element and the antenna ground; and a capacitor having a first terminal coupled to the first inductor at the first port of the switch.

13. The antenna defined in claim 12 wherein the capacitor has a second terminal coupled to the antenna ground, the antenna further comprising an inductor coupled between the antenna resonating element and the antenna ground in parallel with the adjustable inductor circuit at a location between the antenna feed and the adjustable inductor circuit.

14. The antenna defined in claim 13 wherein the switch has a third port that is coupled to the antenna ground.

15. The antenna defined in claim 14 wherein the antenna resonating element includes metal electronic device housing structures.

16. The antenna defined in claim 15 wherein the metal electronic device housing structures comprise peripheral housing structures that run along at least one edge of an electronic device housing.

17. An electronic device, comprising:

peripheral conductive housing structures;

a hybrid inverted-F slot antenna, wherein the hybrid inverted-F slot antenna has an inverted-F antenna portion formed from an inverted-F antenna resonating element and an antenna ground, wherein the inverted-F antenna resonating element is formed from the peripheral conductive housing structures, wherein the hybrid inverted-F slot antenna has a slot antenna portion formed from an opening between the inverted-F antenna resonating element and the antenna ground, and wherein the hybrid inverted-F antenna has an antenna feed that feeds both the inverted-F antenna portion and the slot antenna portion;

an adjustable inductor having at least first and second inductors coupled to first and second ports of a switch, wherein the adjustable inductor is coupled between the inverted-F antenna resonating element and the antenna ground; and a capacitor having a first terminal coupled to the antenna ground and a second terminal coupled to the first inductor at the first port of the switch.

18. The electronic device defined in claim 17 further comprising an inductor that is coupled between the inverted-F antenna resonating element and the antenna ground in parallel with the adjustable inductor.

19. The electronic device defined in claim 18 wherein the inductor is coupled between the inverted-F antenna resonating element and the antenna ground at a location that is between the adjustable inductor and the antenna feed.

20. The electronic device defined in claim 19 wherein the first and second inductors have different first and second inductor values and wherein adjustments to the adjustable inductor tune the antenna.

* * * * *